US006499855B1

(12) United States Patent
Kukuk

(10) Patent No.: US 6,499,855 B1
(45) Date of Patent: Dec. 31, 2002

(54) COMBINATION POLICE BATON

(76) Inventor: Craig Kukuk, 13111 W. Telemark Ct., Boise, ID (US) 83713

( * ) Notice: Subject to any disclaimer, the term of this patent is extended or adjusted under 35 U.S.C. 154(b) by 0 days.

(21) Appl. No.: 09/699,846

(22) Filed: Oct. 29, 2000

Related U.S. Application Data

(60) Provisional application No. 60/162,251, filed on Oct. 29, 2000.

(51) Int. Cl.[7] ..... A45B 3/02
(52) U.S. Cl. ..... 362/102; 362/109; 362/96
(58) Field of Search ..... 362/102, 109, 362/96

(56) References Cited

U.S. PATENT DOCUMENTS

| | | | | | |
|---|---|---|---|---|---|
| 3,737,649 | A | | 6/1973 | Nelson et al. | 240/6.42 |
| 3,776,429 | A | | 12/1973 | DeLucia | 222/162 |
| 4,186,851 | A | | 2/1980 | Cantor | 222/113 |
| 4,223,804 | A | | 9/1980 | Morris et al. | 222/3 |
| 5,086,377 | A | | 2/1992 | Roberts | 362/102 |
| 5,287,255 | A | * | 2/1994 | Strodtman | 362/102 |
| 5,405,134 | A | * | 4/1995 | Wolfram | 362/102 |
| 5,446,985 | A | | 9/1995 | Chen | 42/1.08 |
| 5,683,168 | A | | 11/1997 | Teig et al. | 362/96 |
| 5,795,054 | A | | 8/1998 | Booty, Jr. | 362/96 |
| D401,374 | S | | 11/1998 | Lum | D26/38 |
| 6,139,165 | A | * | 10/2000 | Crowe | 362/102 |
| 6,199,997 | B1 | * | 3/2002 | Ousten et al. | 362/109 |
| 6,386,726 | B1 | * | 5/2002 | Macierowski et al. | 362/102 |

* cited by examiner

*Primary Examiner*—Stephen Husar
*Assistant Examiner*—Anabel Ton
(74) *Attorney, Agent, or Firm*—Pedersen & Co., PLLC; Ken J. Pedersen; Barbara S. Pedersen

(57) ABSTRACT

The invention is an extendable police baton, which preferably includes several of the tools often needed by police personnel. In one embodiment, the baton comprises an extendable portion, flashlight, pepper sprayer and glass breaker with an integral, orthogonal handle, wherein the orthogonal handle contains the sprayer. In another embodiment without an orthogonal handle, the baton comprises a pepper sprayer which is located in the same end of the baton as the flashlight. Preferably, more than one handle/sprayer unit can cooperate with the same extendable baton/glass breaker unit, so that the user may select the style particularly advantageous for the user or the service in which it will be used.

12 Claims, 7 Drawing Sheets

9
102
14
18
27
122
9
18
27
4
2
3
23
19
6
27
101

COMBINATION POLICE BATON

This application claims priority from my prior provisional application serial No. 60/162,251, entitled Combination Police Baton, filed Oct. 29, 2000, herein incorporated by reference.

BACKGROUND OF THE INVENTION

1. Field of the Invention

This invention relates generally to law enforcement equipment. More specifically, this invention relates to different combinations of a flashlight, pepper sprayer and glass breaker in an extendable policeman's baton, with or without an orthogonal handle.

2. Related Art

U.S. Pat. No. 3,737,649 (Nelson et al.) discloses a combination baton-flashlight.

U.S. Pat. No. 3,776,429 (DeLucia) discloses a combination flashlight and propellant discharge device.

U.S. Pat. No. 4,186,851 (Cantor), and U.S. Pat. No. 4,223,804 (Morris et al.) disclose a pepper spray cannister in a flashlight. U.S. Pat. No. 5,446,985 (Chen), U.S. Pat. No. 5,683,168 (Teig et al.), and U.S. Pat. No. 5,795,054 (Bootv. Jr.) also disclose a pepper spray cannister in a flashlight.

U.S. Pat. No. 5,086,377 (Roberts) discloses a combination baton and propellant discharge device.

U.S. Pat. No. 401,374 (Lum) discloses ornamental features for a combination flashlight and propellant discharge device in a police baton with a bolt-on orthogonal handle.

In addition, Armament Systems and Procedures, Inc. (A.S.P.) of Appleton, Wis., U.S.A. offers a Tac-Lites® combination flashlight and extendable baton.

Still, there is a need for a compact but effective combination extendable police baton with special features of a flashlight, pepper sprayer and optional glass breaker. Also there is a need for such a combination baton with or without an integral orthogonal handle. This invention addresses that need.

SUMMARY OF THE INVENTION

The invention is a combination extendable police baton that may serve an officer's need to have various features and options quickly at hand, while keeping the officer's gun hand free. In one embodiment, the baton comprises a flashlight, pepper sprayer and optional glass breaker with an integral, orthogonal handle. In this embodiment, the pepper sprayer or other deterrent sprayer is preferably in the orthogonal handle. In another embodiment without an orthogonal handle, the baton comprises a pepper sprayer which is located in the same end of the baton as the flashlight.

The invented combination baton allows several important devices to be easily at hand for a policeman or policewoman, in a single unit, which only needs to be help with one hand, thus leaving the gun hand free. Also, the invented combination baton places both defensive and offensive tools together in the user's hand, along with a flashlight. The user keeps a light, pepper spray, and a baton for offensive or defensive action all in a ready position in one hand, while the gun hand is free. Thus, a police officer has all the commonly-used tools ready at a given time, which greatly increases his options when dealing with the uncertainties of a suspect's behavior. The officer may approach a suspect with the invented baton in one hand and his other hand ready at his gun, and he may respond to the suspect's behavior as appropriate. The user need not whisk out a pepper spray container or a baton is he senses they may be needed, which actions can be threatening and confrontational and can escalate the situation. Instead, he can hold and use the combination baton as a flashlight, which are non-threatening actions, while having the other defensive and offensive tools ready for use. Thus, the invented combination baton allows the user to be more in control of the situation, and ready for many turn of events.

Another object of the invented combination baton is to eliminate the need for several different objects (spray, baton, flashlight) to be clipped separately onto an officer's belt. This eliminates the "clutter" of the separate objects, and reduces total weight because the invention may weigh significantly less, by about 2 or 3 pounds, than the total of the separate objects. Also, for a female officer with a small waist, it is difficult to position the separate objects around her belt.

DESCRIPTION OF THE PREFERRED EMBODIMENTS

Referring to the Figures, these are depicted several, but not all, embodiments of the present invention, which is a combination police baton. In the following description of the preferred embodiments, the term "distal" refers to the end of the baton from which the extendable baton extends and that includes the glass breaker tip, and "proximal" refers to the end containing the flashlight. Because of the typical use of the invented baton with flashlight pointing forward from the user, the flashlight end is also referred to as the "forward" direction, and the glass breaker end is also referred to as the "rearward" direction.

Figure 1:
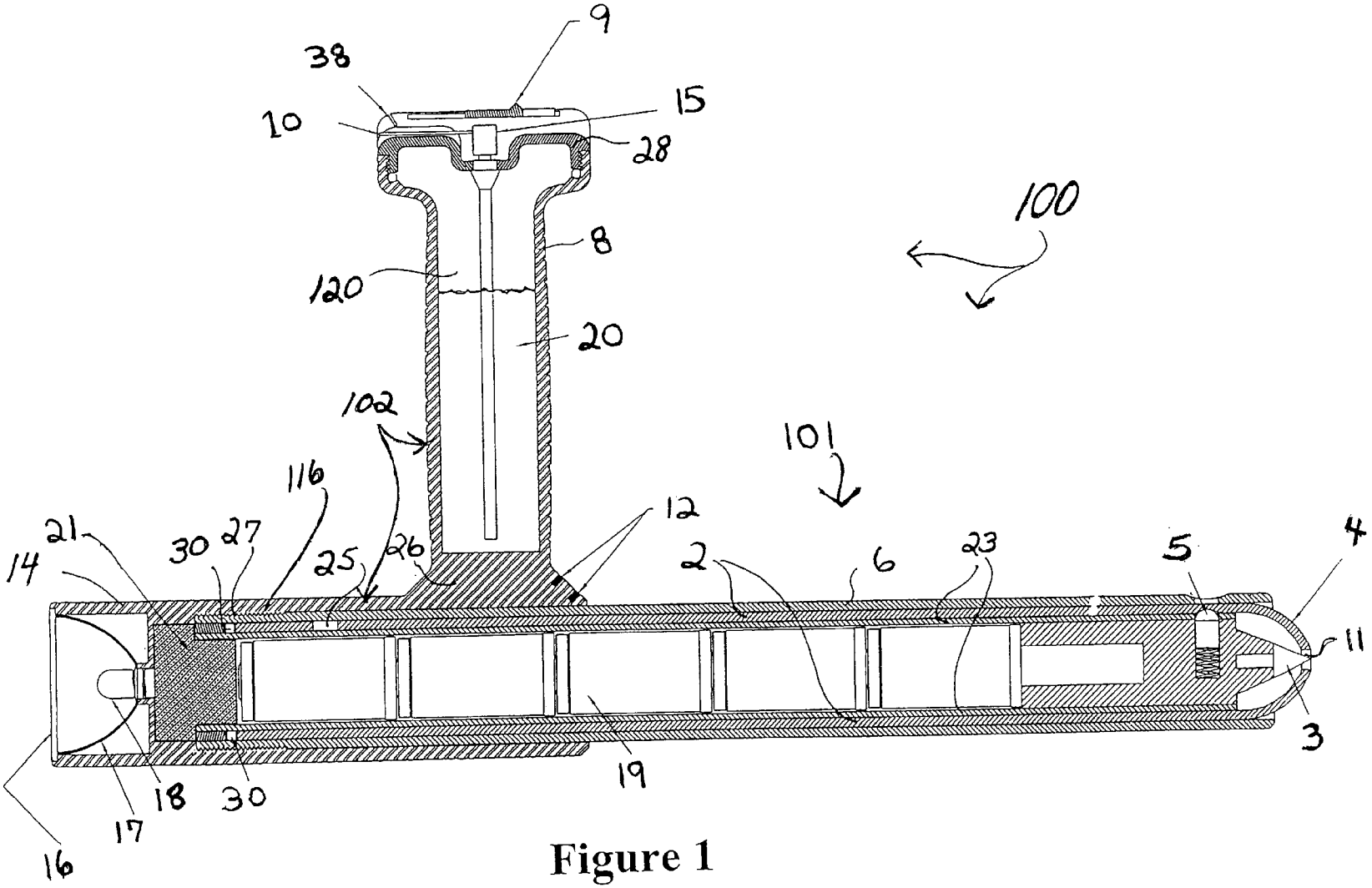
FIG. 1 depicts in side cross-section a first embodiment of the invention with an integral, orthogonal handle, wherein the baton is collapsed or "compacted."
Figure 2:
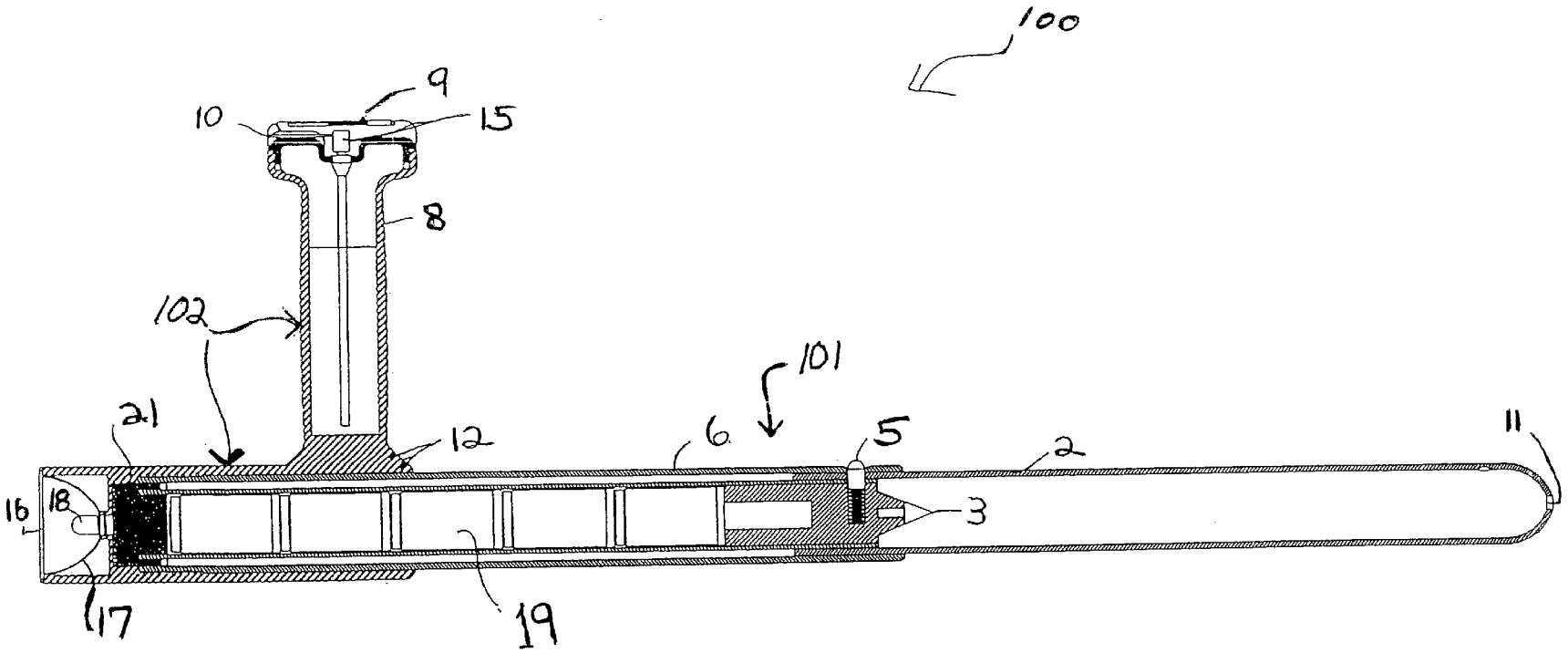
FIG. 2 depicts the embodiment of FIG. 1, wherein the extendable baton is extended.
Figure 6:
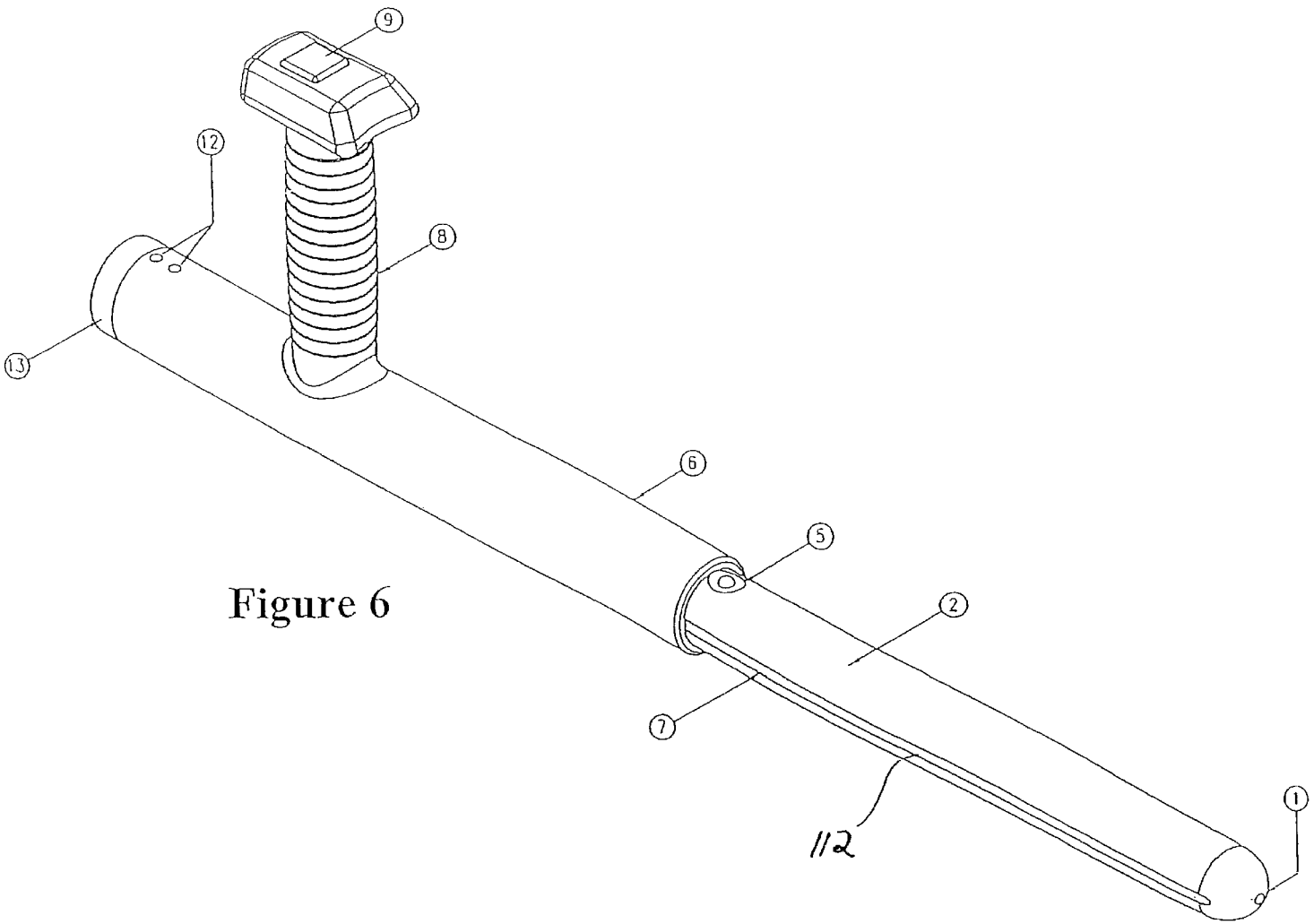
FIG. 6 is a perspective view of an orthogonal-handle embodiment of the invention, illustrating one embodiment of a channel-style baton guide system.

FIGS. 1 and 2 depict a first embodiment of the invented combination baton 100, which comprises a body 101 and a handle unit 102. According to these Figures, the body 101 of the preferred embodiment comprises a generally cylindrical housing 6, which serves as both a storage cell housing and also an extendable baton guide, and a slidably extendable baton 2. Extendable baton 2 is generally cylindrical and hollow, and when not extended, fits smoothly within the exterior shell of housing 6, and around the storage cell pack 19 within housing 6. Housing 6 is also generally cylindrical and hollow, and so is capable of receiving extendable baton 2 completely, except for preferably distal end 4, which is herein called a "first position" for the baton 2. This way, the baton of this invention is compact, sturdy, and available in an instant to be employed into its extended configuration, which is herein called its "second position." Preferably with a quick wave of the baton, an action which might be called "whipping out the baton," the centripetal force of the wave causes extendible baton 2 to push button 5 down out of the way and to slide all of the way out to an extended second position. As the extendable baton 2 slides out, it is guided by a mechanism that prevents rotation of the baton 2 relative to the housing 6 and, in doing so, prevents jamming and malfunctioning. The preferred guide mechanism, illustrated in FIG. 6, is a channel system which includes a longitudinal channel 112 on a side of the extendable baton 2 that receives and slides along a cooperating protrusion (not shown) in the housing 6 on the inner surface of the housing 6. The channel 112 extends from near the distal end 4 to near but not all the way to the proximal end of the baton 2. This way, when the baton 2 is fully extended, its sliding is permitted until the baton is most of the way out of the housing 6, except for a few inches required to keep the housing 6—baton 2 connection sturdy and reliable. The sliding extension of the baton 2 is preferably limited by the protrusion on the housing reaching the end (proximal end) of the channel 112, so that the baton 2 can move no farther out from the housing. Also, when the extendable baton 2 has reached its farthest-out position, button 5 pops up into a retaining hole 25 to lock the baton in the extended position until the user wishes to compact the baton. To compact the baton, baton lock button 5 may be pressed down to allow the extendible baton 2 to clear the button and draw back into housing 6.

Another preferred feature of the body 101 of the baton 100 is a glass breaker member, which preferably may be used by punching the extendable baton end of the baton 100 against glass. The glass breaker member preferably comprises glass breaker sleeve 23 with a sharp tip 3, and this sleeve 23 is secured or retained at its proximal end to the distal end of storage cell housing/baton guide 6. At the proximal end of housing 6 is a rebound spring 30 which permits a small amount relative travel between glass breaker sleeve 23 and extendable baton 2, but which biases the extendable baton 2 to the position shown in FIG. 1. Rebound spring 30 is a spring or wave washer or other biasing device that may serve to serve this function. In the biased position of FIG. 1, tip 3 is in the opening 11, but protected by the surrounding surfaces of distal end 4 so that tip is not a danger to the user or a bystander. This way, the baton may be used as an effective tool for breaking panes of glass, the punch tip 3 acting as a sharp point of contact to initially perforate the glass.

More specifically, in the preferred embodiment of FIGS. 1 and 2, distal end 4 extends a short distance from the housing 6, for example, 1–2 inches, to provide the glass breaker features of the invented baton. Extendable baton 2 has an opening 11 at its distal end 4 for receiving glass breaker punch tip 3. Punch tip 3 is configured to extend slightly into opening 11, but to not extend out from the opening 11, when extendable baton 2 is retracted. Punch tip 3 is the distal end of a glass breaker sleeve 23, which is a hollow, preferably generally cylindrical sleeve received inside and coaxial with extendable baton 2. Sleeve 23 extends from near distal end 4 substantially all the way to proximal end 14, where it is retained from axial movement by bulb holder 21. Extendible baton 2 is slidably received in housing 6 and is also slidable relative to sleeve 23, so that when distal end 4 is impacted, extendible baton 2 slides axially forward relative to housing 6 and sleeve 23, further into housing 6 to a position herein referred to as a "third position" wherein the tip 3 is exposed, if only for a second, for use. As a result, distal end 4 moves to relative to punch tip 3 so that tip 3, in effect, moves from its protected position just inside opening 1 to a glass-breaking position protruding slightly from opening 11. This way, with a quick punch at a glass pane with the distal end 4 of the combination baton 100, the tip 3 "comes out" to punch into the pane. Assuming the glass is tempered safety glass, a punch by the tip 3 will perforate the pane and normally cause it to shatter. Thus, the user may easily open, for example, a window of an automobile at an accident site. In this first embodiment, near the flashlight end of the combination baton 100 is handle unit 102, which comprises exterior shell and handle 8. Orthogonal baton handle 8 preferably extends integrally from exterior shell 116 to form unit 102. Handle 8 extends perpendicularly and smoothly from exterior shell 116, at sturdy and preferably non-flexing comer 26. Exterior shell 116 coaxially surrounds the proximal ends of the components that comprises the body 102, that is, housing 6, baton 2 and sleeve 23. Preferably, exterior shell 116 and the proximal end of housing 6 connect by threaded connection 26, so that housing 6 and shell 116 can be unscrewed from each other by opposite relative rotational motion. Alternatively, the shell may be connected by other detachable systems that allow the handle unit 102 to be detachable from the body 101. This way, handle 8 is securely and safely connected to housing 6, until mechanisms in the baton 100 must be replaced or repaired, or until the user wishes to change the handle 102 out for another style of handle unit.

By unscrewing the housing from the shell 116, one may reach the lamp bulb 18 (preferably quartz halogen) and battery pack 19 for replacement, and may send the shell/handle unit to the appropriate party for refill of the reservoir 120 with pepper spray refill. The location of handle 8 on housing 6 is determined from balance, weight and center-of-gravity considerations. Preferably, handle 8 is about 30–40% of the distance from the flashlight end to the glass breaker end of the combination baton 100.

On the handle unit 102, preferably near the middle of the baton 100, are contacts 12 for quick-re-charging the storage cells 19, which are contained inside housing 6. The baton 100 includes wiring and other mechanisms necessary to connect the contacts 12, cells 19, flashlight switch (discussed below), and also the flashlight mechanism at the proximal end 14 of the baton 100. The flashlight mechanism may include shatter-proof lens 16, reflector 17, bulb 18 and bulb holder/conductors/insulators/supports/spring mechanism 21 as conventionally necessary to enable a conventional flashlight to operate at this invented location. Optionally, the front end of the handle unit 102, where the lens 16 is located, may include a cap or other means for removing the lens to reach the bulb 18.

Handle 8 is cylindrical and hollow, and receives in its interior reservoir 120 pepper spray liquid 20. At the top end of handle 8 is combination cover/flashlight switch 9. Cover/switch 9 both controls the flashlight and prevents unintentional discharge of pepper spray from handle 8. When slid forward, cover/switch 9 turns the flashlight feature on, and uncovers pepper spray valve button 15 to make the pepper spray feature available. When the cover/switch 9 is slid rearward, it turns the flashlight off, and rests in a position that covers the valve button 15, preventing access to the button and, hence, accidental discharge of the spray. The switching and wiring mechanisms necessary to operatively connect the flashlight bulb in the proximal end of the baton 100 to the cover/switch 9 at the outer end of the handle 8, and likewise to the cells and contacts, may be installed in handle 8, through unit 102 and mechanism 21, as will be within the skill in the art after seeing the disclosure of this invention.

Optionally, there may be a system that allows the user to uncover the button 15 for use of the spray, while the flashlight remains off. For example, the cover/switch 9 may be adapted to have a third position which uncovers the spray valve button but does not turn on the flashlight. Or, an officer who is using the invented baton during the day, may unscrew the bulb or other flashlight connection to prevent the flashlight from shining.

The configuration of the invented baton 100, with the control for both the flashlight and the pepper spray being on/in the handle 8 makes the invented baton 100 especially beneficial to the user. This way, the user may grip the baton handle 8 in his one hand, and the controls are immediately available to his fingers or thumb. For example, the user may grip the baton 100, pointing the flashlight at a suspected criminal or at a suspected crime scene, and at the same time of this un-threatening and non-confrontational act, the pepper spray is immediately available with just a finger or thumb movement. By pressing on the spray valve button, pepper spray may be discharged from the front of handle 8 through valve button 15 and through spray port 10. Also, whether or not the flashlight is being used, the invented baton 100 may be used as a defensive tool (gripped in the hand at handle 8 with the distal portion of the baton 100 extending below the arm along the forearm for a shield), or the baton 100 may be used offensively (with the baton grasped in the hand but held across the chest and ready to "whip" the baton out to extend the extendable baton). Either in defensive or offensive mode, the pepper spray mechanism is still immediately available by action of the hand gripping the handle. Thus, many situations are controlled to be safer and more successful—a suspected criminal is not as likely to violently react to an officer "whipping" out a pepper spray cannister from his belt, yet the officer is better protected because the spraying mechanism is already pointed at the suspect from the beginning of the situation.

In the FIGS. 1 and 2 embodiment, the cap 28 of the handle 8 may be unscrewed to reveal the internals of the spraying mechanism and for refill, if needed. As discussed below, several different configurations may be used for the spray mechanism, for example, refillable reservoir inside the handle, or replaceable cartridge inside the handle. In addition, handle 8 may include a slot 38 at the forward side of the handle for holding the officer's identification card. This way, the officer has the necessary ID easily available to show to someone, without the officer having to reach for it, which reaching could again be construed by mistake as a threatening action or could place the officer off-guard or distracted.

Figure 3:
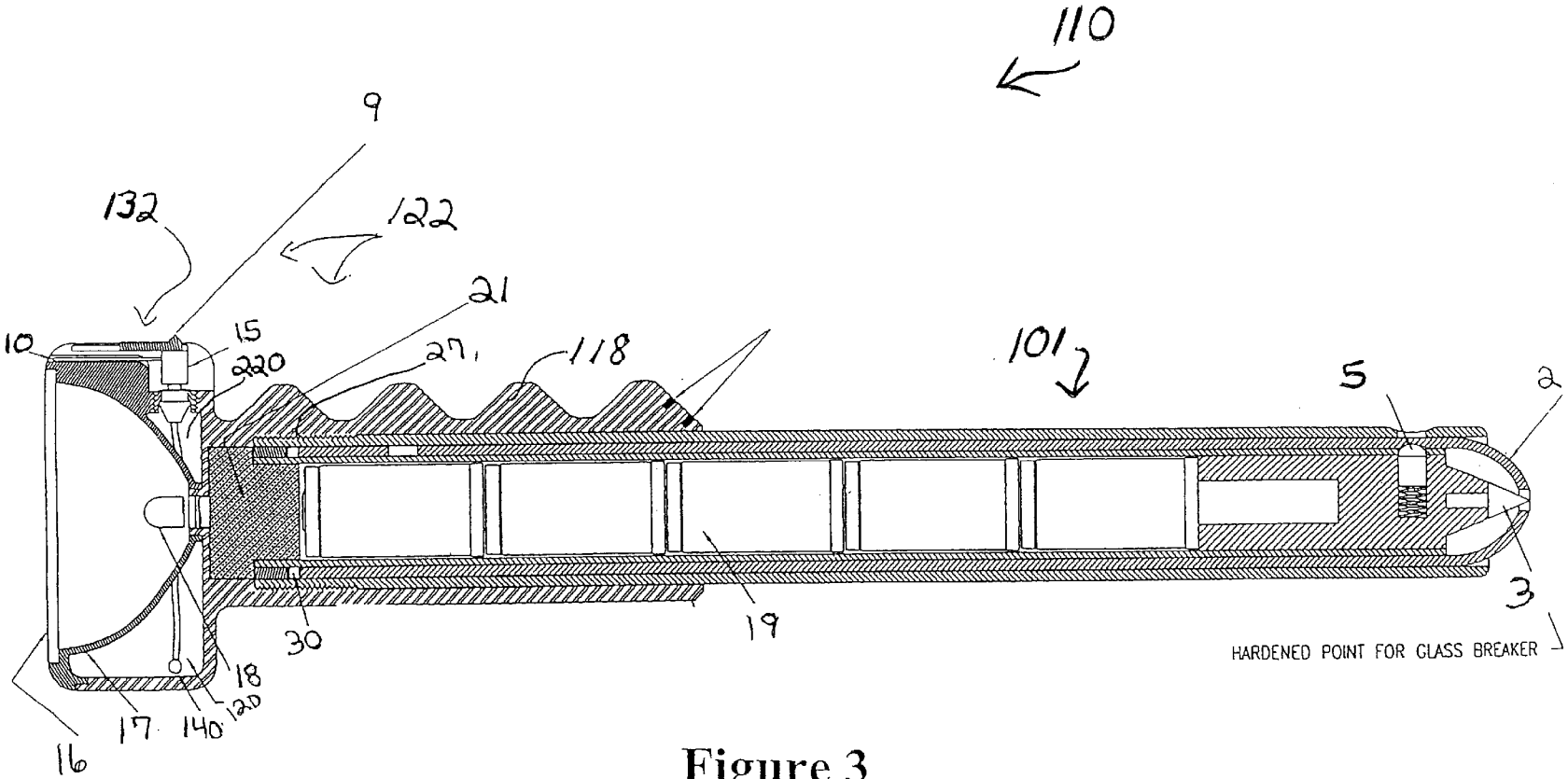
FIGS. 3 and 4 depict in side cross-section a second embodiment of the invention, without an orthogonal handle, and with a pepper sprayer in the same end of the baton as the flashlight, in the compacted and extended positions, respectively.
Figure 4:
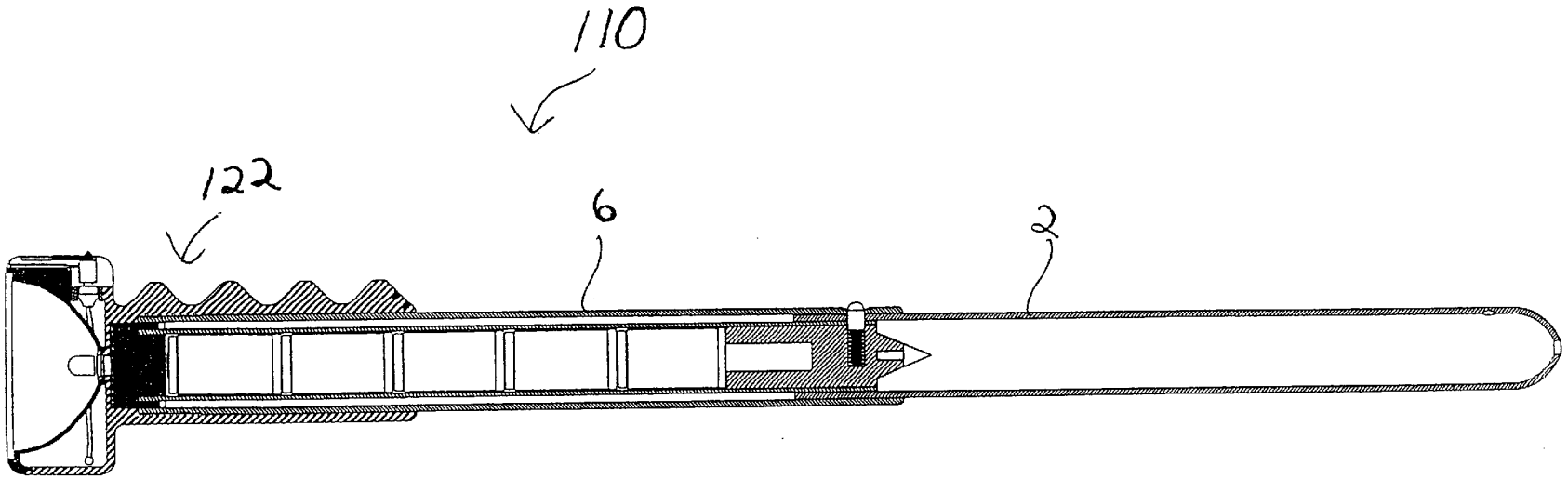

FIGS. 3–4 depict a second embodiment of the invention. According to these Figures, the baton 110 of the invention has the same body 101 as the FIGS. 1 and 2 baton 100. Therefore, the same body structure and function are supplied to baton 110 by supplying the same baton guide/housing 6, extendable baton 2, opening 11, glass breaker punch tip 3, and lock button. Also, storage cell pack 19, contacts 12, lens 16, reflector 17, bulb 18 and bulb holder/conductors/insulators/supports/springs etc. 21 are the same.

In this second embodiment 110, however, the handle unit 122 is different from the handle unit 102 of baton 100, but is connected to the body 101 by the same connection system 27 as handle unit 102 to body 101. Thus, the handle units 102, 122 are interchangeable on the body 101, depending on the preference of the user or the police force purchasing them or the particular situation. On handle unit 122, there is no orthogonal handle. Instead, the handle unit 122 includes a flashlight end 132 and a coaxial handle 118. Instead of being disposed in the handle, the deterrent spray system is located within the flashlight end 132 of the baton, preferably circumscribing the conductors/insulators/supports/springs, etc., and reflector of the flashlight. Inside the flashlight end 132 is a reservoir 220 for receiving the spray liquid 20, and in fluid communication with the reservoir is a sprayer system including a flop tube with weighted end 140 and spray valve 15 and wand 10. Also, combination cover/flashlight switch 9 and pepper spray valve button 15, which in this embodiment are also located in the flashlight end of the baton, operate the same as in the previously discussed embodiment. With this handle unit 122, the user grasps the handle 118, which preferably surrounds the outer circumference of the baton 110 in an ergonomic shape, to point the flashlight end 132 (with cover/switch 9 in the on, spray-enabled position) at a suspect or at a situation. With a thumb or finger of the same hand, the user may, if need be, actuate the spray valve to discharge the spray liquid.

With the invented handle units 102, 122, the spray systems are positioned so that there is a very high probability that they will work well. Prior art spray devices in batons typically fail frequently because the spray mechanism is in tilted or tipped positions (parallel to the longitudinal axis of the baton) in which it does not work very well—the tube does not stay in the liquid. With the invented orthogonal handle unit, the user controls the position of the spray mechanism and the tube in the liquid, because the tube is kept parallel to the hand grasping the handle, which is normally upright. The user can very clearly know whether the sprayer will work because all he/she has to do is keep the handle 8 upright, and that is the preferred position for use of the invented baton anyway. In the coaxial design, the "flopping" tube is used to ensure the tube stays in the liquid, and the ergonomic handle design also tends to keep the flashlight and spray wand in the proper position.

Figures 5A, 5B, 5C:
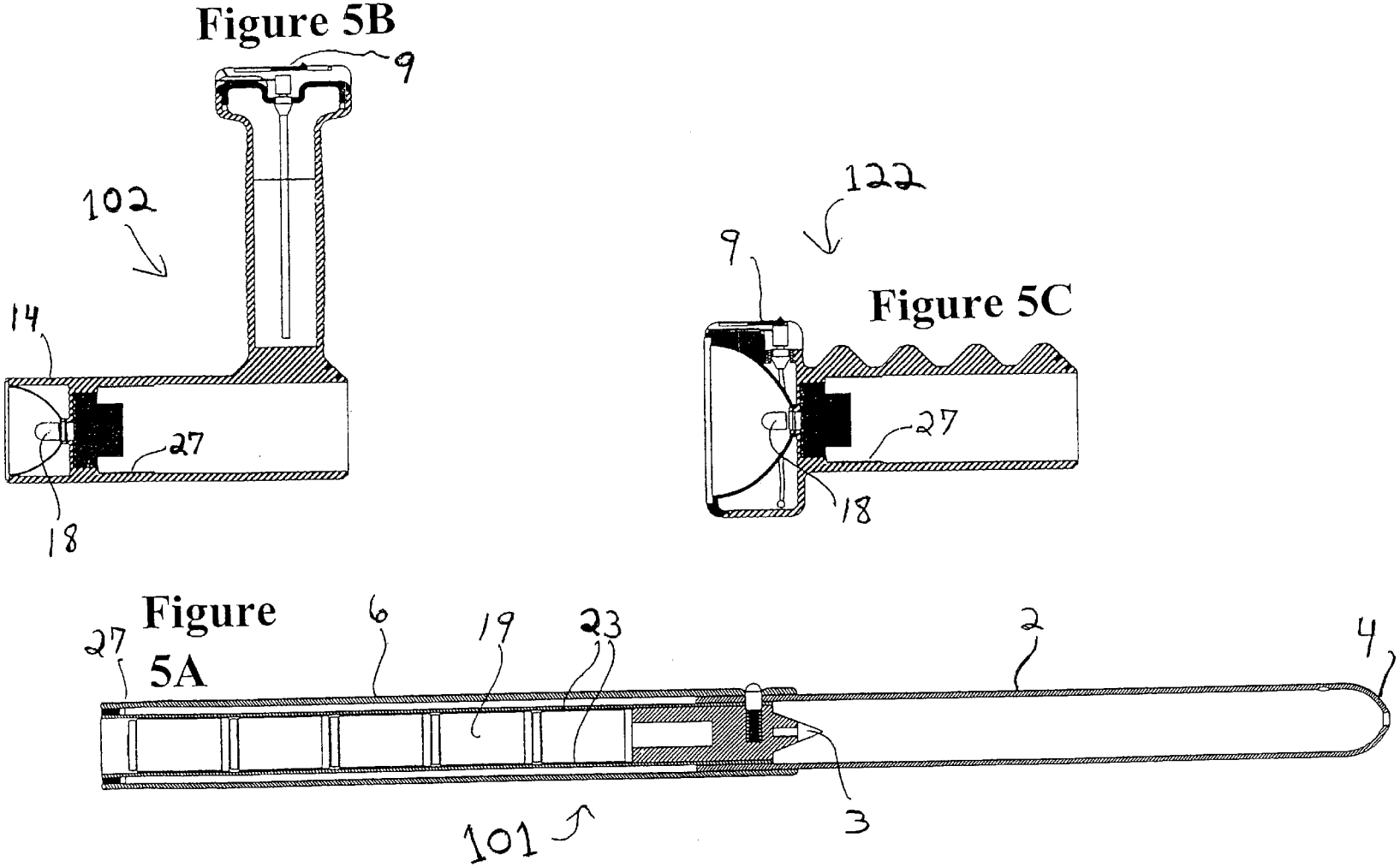
FIGS. 5A–5C are side, cross-section views of the alternative component parts of one embodiment of the invention, namely baton part (FIG. 5A), flashlight with integral, orthogonal handle with pepper sprayer (FIG. B), and flashlight with pepper sprayer in the same end as the flashlight (FIG. 5C).

FIGS. 5A, 5B, and 5C further illustrate the modular approach to the invented baton 100, 110. FIG. 5A shows the standard body 101 of the invented baton, with the extendable baton 2 in the extended position. FIG. 5B shows an orthogonal handle unit 102. FIG. SC shows a coaxial handle unit 122. Either of the handle units in FIGS. 5B or 5C may be used with the same body (FIG. 5A), giving options for the user or the police force.

Figure 7:
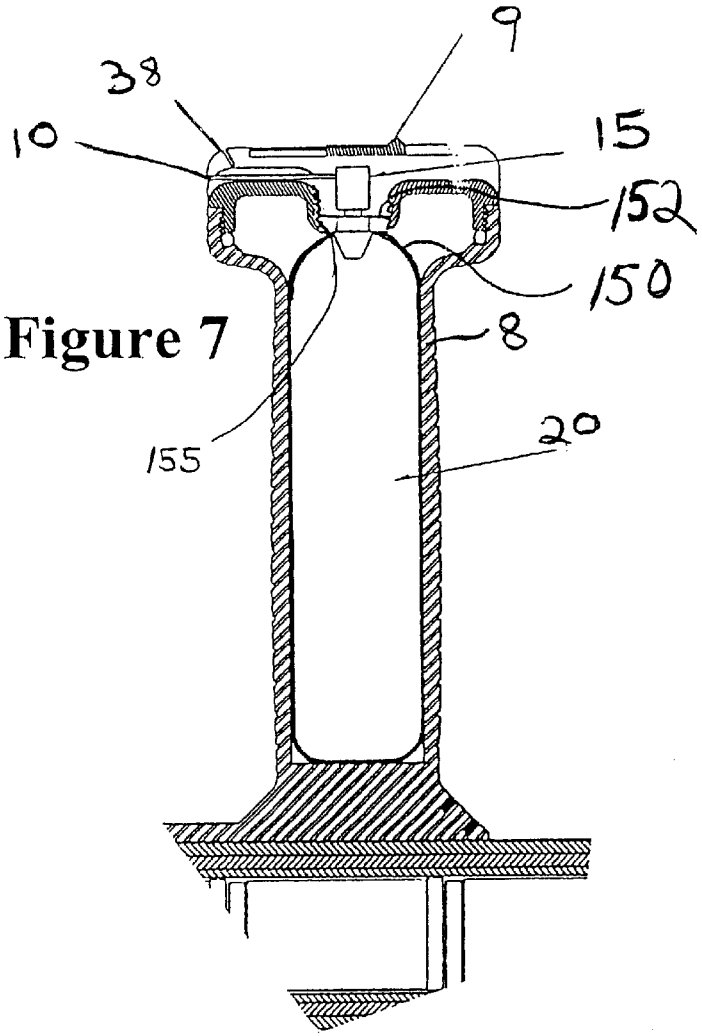
FIG. 7 is a detail view of one embodiment of a cannister spray system for providing an easily-replaceable spray cannister in an orthogonal handle.

Optionally, as shown in the detail of FIG. 7, a cannister system may be used in the baton of the invention. Particularly well-adapted to the orthogonal handle unit 102, the handle 8 may be adapted to receive a cannister 150 pre-filled with liquid spray. Preferably, the cannister 150 has an outer generally cylindrical surface to slide into, and fit closely in, the inside surface of the handle. Preferably, also, the cannister 150 has a top end 152 that connects with the cap of the handle or other surface of the handle. This connection may comprise, for example, the cannister wall threading to the cap, as shown in FIG. 7 as threaded connection 155, or a snap-fit or other frictional and secure connection. This secure connection ensures that the proper cannister with proper contents is being used in the baton, and also that the cannister will not become dislodged in the handle and possibly be damaged or inoperable. Preferably, the secure connection does not simply comprise a fluid stem of the cannister being inserted into the spray valve button, but rather a connection between the cannister wall/housing and the cap/handle wall. Another benefit of the preferred secure connection between cannister and cap, is that removal of the cap will also pull the cannister out of the handle for replacement. This way, the cap becomes a handling mechanism for the cannister, to ensure safety and sureness in installation and use.

I claim:

1. A combination baton for law enforcement personnel, the combination baton comprising a body and a handle unit, the body comprising:

a housing and an extendable baton slidably connected to the housing so that the extendable baton slides on a longitudinal axis to a compact first position substantially inside the housing, and an extended second position out from the housing; and the handle unit comprising a handle and a flashlight mechanism opposite the extendable baton, wherein the handle comprises an elongated member extending from the handle unit generally orthogonally to the longitudinal axis, an interior reservoir for containing deterrent spray and a spray valve mechanism for dispensing the deterrent spray, and a flashlight on-off switch electrically connected to the flashlight mechanism, wherein the flashlight on-off switch comprises a member that is slidable to cover the spray valve mechanism when the switch is in an off position.

2. The combination baton of claim 1, wherein the handle unit is detachable from the body.

3. A combination baton for law enforcement personnel, the combination baton comprising a body and a handle unit, the body comprising:

a housing and an extendable baton slidably connected to the housing so that the extendable baton slides on a longitudinal axis to a compact first position substantially inside the housing, and an extended second position out from the housing; and the handle unit comprising a handle and a flashlight mechanism opposite the extendable baton, wherein the handle comprises an elongated member extending from the handle unit generally orthogonally to the longitudinal axis, wherein the handle has an interior space for containing a deterrent spray cannister, and a spray valve mechanism for dispensing the deterrent spray, and a flashlight on-off switch electrically connected to the flashlight mechanism, wherein the flashlight on-off switch comprises a member that is slidable to cover the spray valve mechanism when the switch is in an off position.

4. The combination baton of claim 3, wherein the handle unit is detachable from the body.

5. A combination baton for law enforcement personnel, the combination baton comprising a body and a handle unit, the body comprising:

a housing and an extendable baton slidably connected to the housing so that the extendable baton slides on a longitudinal axis to a compact first position substantially inside the housing, and an extended second position out from the housing; and the handle unit comprising a handle and a flashlight mechanism opposite the extendable baton, wherein the handle comprises an elongated member extending from the handle unit generally orthogonally to the longitudinal axis, the handle comprising a deterrent spray mechanism;

wherein the body comprises a pointed glass breaking member with a pointed tip, and wherein the extendable baton has a hole and slides relative to the pointed glass breaking member to slide from said position to a third position, farther inside the housing than the first position, wherein the pointed tip extends through the hole and is exposed.

6. A combination baton for law enforcement personnel, the combination baton comprising a body and a handle unit, the body comprising:

a housing and an extendable baton slidably connected to the housing so that the extendable baton slides on a longitudinal axis to a compact first position substantially inside the housing, and an extended second position out from the housing; and the handle unit coaxial with the body and comprising a flashlight mechanism opposite the extendable baton, wherein the flashlight mechanism comprises a deterrent spray mechanism and a flashlight on-off switch; and wherein the handle unit is detachable from the body; wherein tie flashlight on-off switch comprises a member that is slidable to cover the spray valve mechanism when the switch is in an off position.

7. A combination baton for law enforcement personnel, the combination baton comprising a body and a handle unit, the body comprising:

a housing and an extendable baton slidably connected to the housing so that the extendable baton slides on a longitudinal axis to a compact first position substantially inside the housing, and an extended second position out from the housing; and the handle unit coaxial with the body and comprising a flashlight mechanism opposite the extendable baton, wherein the flashlight comprises a deterrent spray mechanism; and wherein the handle unit is detachable from the body; and wherein the body comprises a pointed glass breaking member.

8. The combination baton of claim 7, wherein the pointed glass breaking member has a pointed tip, and wherein the extendable baton has a hole and slides relative to the pointed glass breaking member to slide from said position to a third position, farther inside the housing than the first position, wherein the pointed tip extends through the hole and is exposed.

9. A combination baton for law enforcement personnel, the combination baton comprising a body and a plurality of handle units, wherein the handle units are interchangeably connectable to the body, the body comprising:

a housing and an extendable baton slidably connected to the housing so that the extendable baton slides on a longitudinal axis to a compact first position substantially inside the housing, and an extended second position out from the housing; and wherein a first of said plurality of handle units comprises a handle and a flashlight mechanism opposite the extendable baton, wherein, the handle comprises an elongated member that, when said first of said plurality is connected to the body, extends from the handle unit generally orthogonally to the longitudinal axis, and wherein the handle comprises a deterrent spray mechanism.

10. The combination baton as in claim 9, wherein a second of said plurality of handle units detachable connects to the body coaxially with the body, comprises a flashlight mechanism opposite the extendable baton, and comprises a deterrent spray mechanism.

11. A handle unit for detachable connection to a law enforcement baton, the handle unit comprising a detachable connection mechanism for connecting to a law enforcement baton, an interior space, a deterrent spray cannister, and a spray valve mechanism, a flashlight switch that is movable to positions comprising a first position which is adapted to turn on a flashlight and to reveal the spray valve mechanism, and a second position which is adapted to turn off a flashlight and to cover the spray valve mechanism.

12. A handle unit as in claim 11 wherein the handle unit is adapted to connect to a law enforcement baton so that the deterrent spray cannister is orthogonal to the baton.

* * * * *